US005775850A

United States Patent [19]

Gale et al.

[11] Patent Number: 5,775,850

[45] Date of Patent: Jul. 7, 1998

[54] ROCK BOLT

[75] Inventors: Winton James Gale, Corrimal; Mieczyslaw Wieslaw Fabjanczyk, Austinmer; Maxwell Thomas Renwick, Mangerton, all of Australia

[73] Assignee: The Broken Hill Proprietary Company Limited, Melbourne, Australia

[21] Appl. No.: 592,313

[22] PCT Filed: Aug. 9, 1994

[86] PCT No.: PCT/AU94/00455

§ 371 Date: Apr. 8, 1996

§ 102(e) Date: Apr. 8, 1996

[87] PCT Pub. No.: WO95/05525

PCT Pub. Date: Feb. 23, 1995

[30] Foreign Application Priority Data

Aug. 12, 1993 [AU] Australia ..... PM 0540

[51] Int. Cl.[6] ..... E21D 20/02

[52] U.S. Cl. ..... 405/259.5; 52/740.1; 405/259.1; 405/259.6

[58] Field of Search ..... 405/259.6; 285/355, 285/390, 333, 334; 52/740.1–740.6

[56] References Cited

U.S. PATENT DOCUMENTS

| | | | |
|---|---|---|---|
| 832,711 | 10/1906 | Webber | 52/740.1 |
| 1,367,182 | 1/1921 | Conkling | 52/740.2 |
| 1,400,278 | 12/1921 | Fougner | 52/740.4 |
| 2,245,419 | 6/1941 | Unke | 285/390 |
| 3,489,437 | 1/1970 | Duret | 285/355 X |
| 4,989,902 | 2/1991 | Putch | 285/355 X |
| 5,104,266 | 4/1992 | Daryoush et al. | 405/259.5 |

FOREIGN PATENT DOCUMENTS

| | | | |
|---|---|---|---|
| 6511386 | 5/1987 | Australia . | |
| 1129592 | 9/1992 | Australia . | |
| 1488692 | 10/1992 | Australia . | |
| 916286 | 12/1953 | Germany . | |
| 1033614 | 12/1958 | Germany . | |
| 1072942 | 1/1960 | Germany . | |
| 3400182 | 7/1985 | Germany | 405/259.5 |
| 762227 | 11/1956 | United Kingdom . | |

OTHER PUBLICATIONS

Derwent Abstract Accession No. 87:078236/11, Class Q49, 23 Jul. 1986 1245710 (Cen Plan Des Techn).

*Primary Examiner*—Dennis L. Taylor

*Attorney, Agent, or Firm*—Kerkam, Stowell, Kondracki & Clarke, P.C.; John C. Kerins

[57] ABSTRACT

A rock bolt (1) adapted to be anchored in a hole in a rock formation by means of a cement or a chemical resin anchor is disanchored. The rock bolt (1) comprises a core (5) on which is formed a profile for optimising the load transfer and the stiffiess properties of the rock bolt (1), the profile comprising opposed sides (6), with one or both sides (6) comprising at least two sections (9, 11), with a first section (9) being steeper than a second section (11).

30 Claims, 6 Drawing Sheets

ROCK BOLT

The present invention relates to a rock bolt that is adapted to be anchored such as by means of a cement or a chemical resin grout (hereinafter referred to as "grout") in a hole drilled in a rock formation.

The term "rock bolt system" as used herein is understood to cover the above described arrangement.

Rock bolt systems are used to stabilise rock formations in a wide range of situations, such as underground and surface mines, tunnels and cuttings, and rock bolts have achieved a high acceptance in both the mining and civil engineering industries.

In any given application, the purpose of a rock bolt system is to apply a clamping or confining action to a failing section of a rock formation to control deformation of the failing section and to enhance the strength of the failing rock section. In other words, the purpose of a rock bolt system is to allow load (forces) to be transferred from a failing section of a rock formation, through the grout, to the rock bolt and to sustain the load (forces).

The performance of a rock bolt system is dependent on the efficiency of transferring load (force) to a rock bolt from a rock formation. The efficiency of transferring load is dependent on the following two parameters.

(a) The maximum shear stress that can be sustained by the rock formation/grout and grout/rock bolt interfaces (the "load transfer" properties of the rock bolt system).

(b) The rate of generating shear stress (the "stiffness" properties of the rock bolt system).

An object of the present invention is to provide a rock bolt for use in a rock bolt system which enables the rock bolt system to have an improved performance when compared with rock bolt systems based on known rock bolts.

According to the present invention there is provided a rock bolt adapted to be anchored in a hole in a rock formation by means of a cement or a chemical resin anchor thereby to form a rock bolt system, the rock bolt comprising a core on which is formed a profile for optimising the load transfer and the stiffness properties of the rock bolt system, the profile comprising opposed sides, with one or both sides comprising at least two sections, with a first section being steeper than a second section.

The present invention is based on the realisation that the structural requirements of a rock bolt that have a bearing on the load transfer properties and the stiffness properties of a rock bolt system based on the rock bolt are different. The present invention is also based on the realisation that the performance of the rock bolt system in terms of these properties can be optimizsed by providing a profile on the rock bolt that has at least two sections on at least one side of the profile of which one section (the "first section") is formed to optimise the stiffness properties and another section (the "second section") is formed to optimise the load transfer properties.

It is preferred that the core be generally cylindrical.

The term "generally cylindrical" as used herein in connection with the core of the rock bolt is understood to cover, but is not limited to, (i) arrangements in which the core is cylindrical; and (ii) arrangements in which the core is cylindrical save for lengthwise extending flats or channels.

It is preferred that the rock bolt comprise a solid core.

It is preferred that the opposed sides of the profile converge to a ridge or apex.

The term "ridge or apex" as used herein in connection with the profile is understood to mean the juncture of the converging sides of the profile.

It is noted that, whilst in theory the juncture of converging sides is a line, in practice the juncture as formed may be rounded or flattened slightly.

It is preferred that both sides of the profile comprise the first and the second sections.

In an alternative arrangement it is preferred that only one side of the profile comprise the first and the second sections.

It is preferred that one or more of the sections of the profile be planar.

It is preferred that one or more of the sections of the profile be curved.

It is preferred that the first section of the profile extend from the core to a junction of the first and the second sections.

It is preferred that the first section describes an angle of 40° to 80° with a longitudinal axis of the rock bolt.

It is preferred particularly that the angle be 45° to 65°.

It is preferred that the second section describes an angle of 10° to 40° with a longitudinal axis of the rock bolt.

It is preferred particularly that the angle be 10° to 30°.

In a situation where both sides of the profile comprise the first and the second sections it is preferred that the first sections be planar and describe an included angle of 40° to 100°.

It is preferred particularly that the included angle be 50° to 90°.

It is preferred more particularly that the included angle be 55° to 75°.

Furthermore, with such an arrangement, it is preferred that the second sections be planar and describe an included angle of 100° to 160°.

It is preferred particularly that the included angle be 120° to 160°.

It is preferred that the total width of the profile, as measured between the junctions of the first sections and the core, be 2 to 10 mm.

It is preferred that the width of the second section(s) of the profile be 40 to 85% of the total width of the profile.

It is preferred particularly that the width of the second section(s) of the profile be 50 to 80% of the total width of the profile.

It is preferred that the height of the profile, as measured between the ridge or apex of the profile and the core, be 0.75 to 5 mm.

It is preferred particularly that the height of the profile be 1 to 3 mm.

In one preferred arrangement, it is preferred that the profile be a series of ribs along the length of the rock bolt.

In a situation where only one side of the profile comprises the first and the second sections, it is preferred that the profile be repeated along the length of the rock bolt such that the first and the second sections are on the same side of each rib.

In an alternative arrangement, it is preferred that adjacent ribs are mirror images with the first and the second sections of one rib being on the opposite side to the first and the second sections of adjacent ribs.

It is preferred that the pitch of the ribs be 5 to 20 mm.

It is preferred particularly that the pitch be 6 to 20 mm.

It is preferred that the ribs form a thread.

In this connection, the thread may be:

(a) continuous or discontinuous;

(b) left or right handed; and (c) single or multi-start.

In another preferred arrangement, it is preferred that the profile be a hoop.

It is preferred particularly that there be a plurality of the hoops spaced along the length of the rock bolt.

The present invention is described further by way of example with reference to the accompanying drawings in which.

Figure 1:
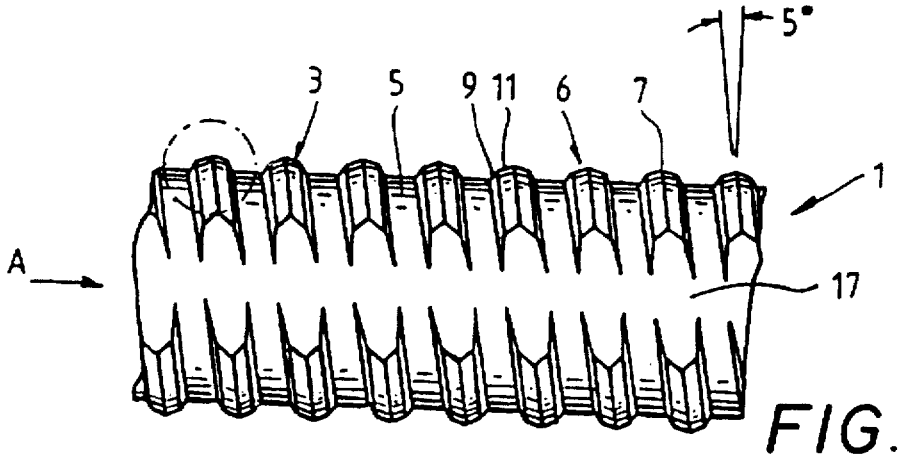
FIG. 1 is a plan view of a section of a length of a preferred embodiment of a rock bolt in accordance with the present invention.
Figure 2:
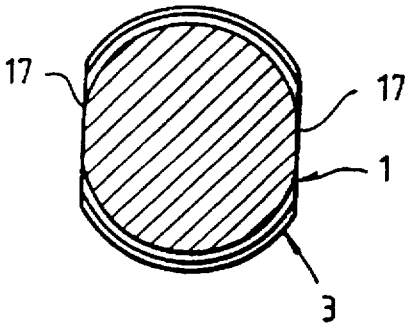
FIG. 2 is an end view in the direction of the arrow A in FIG. 1.
Figure 3:
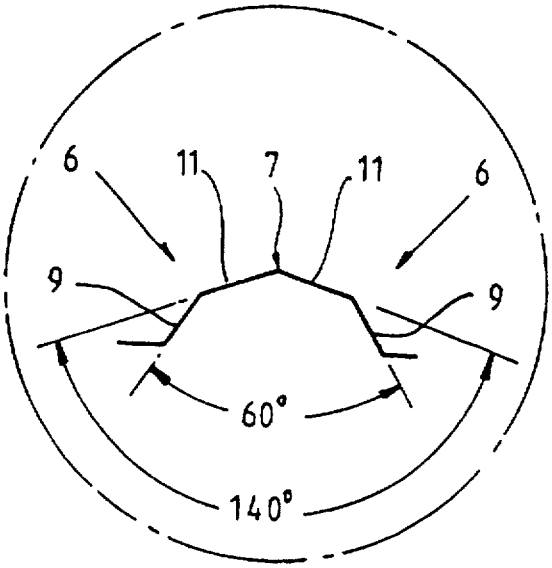
FIG. 3 is an enlarged view of the circled region in FIG. 1.
Figure 4:
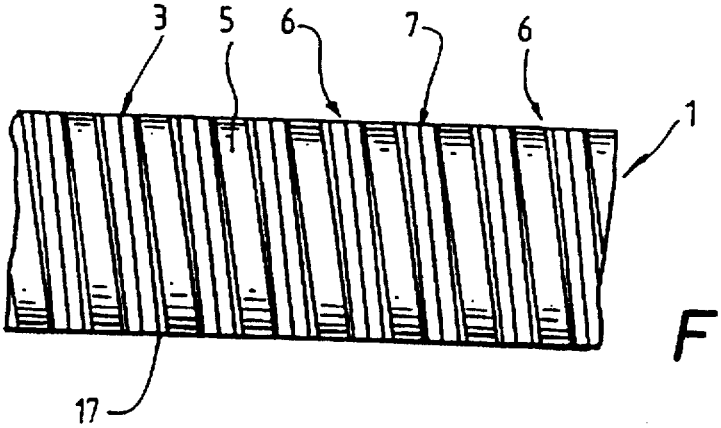
FIG. 4 is a plan view of the section of the rock bolt shown in FIG. 1 rotated through 90° about the longitudinal axis of the rock bolt.
Figure 5:
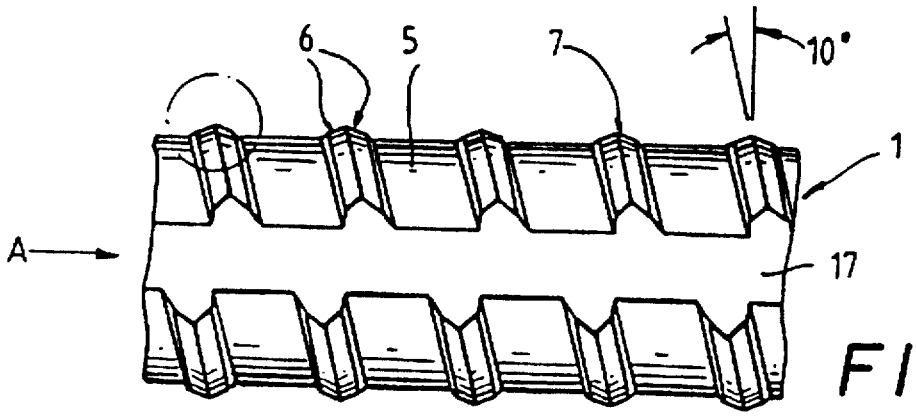
FIG. 5 is a plan view of a section of a length of another preferred embodiment of a rock bolt in accordance with the present invention.
Figure 6:
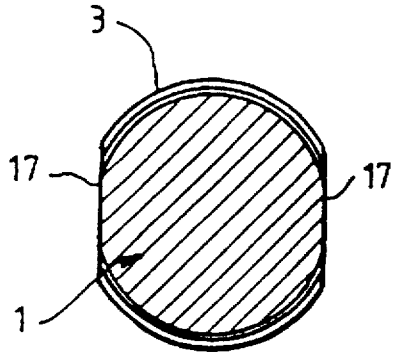
FIG. 6 is an end view in the direction of the arrow A in FIG. 5.
Figure 7:
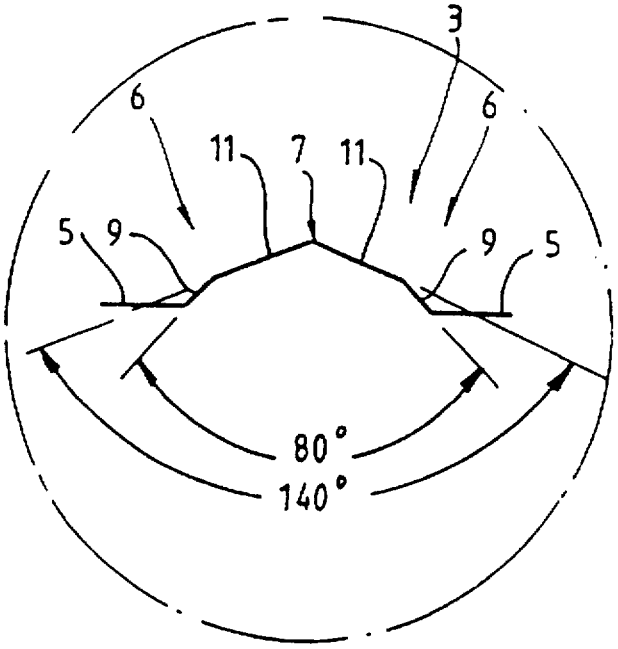
FIG. 7 is an enlarged view of the circled region in FIG. 5.
Figure 8:
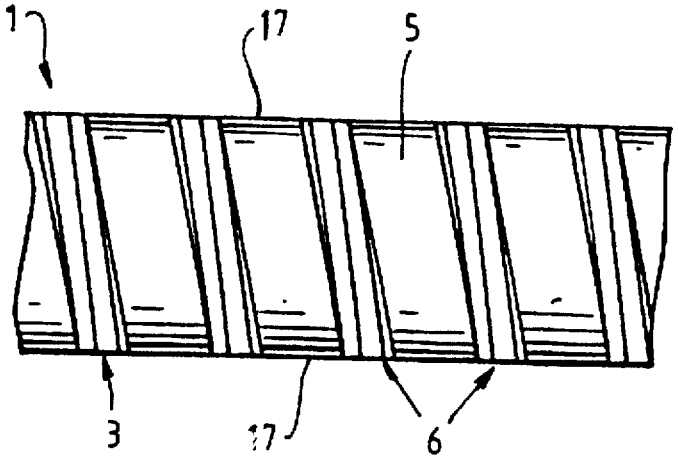
FIG. 8 is a plan view of the section of the rock bolt shown in FIG. 5 rotated through 90° about the longitudinal axis of the rock bolt.
Figure 9:
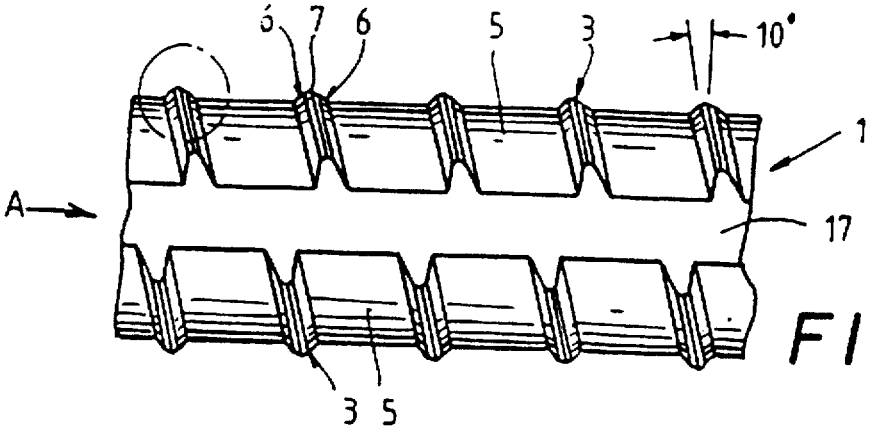
FIG. 9 is a plan view of a section of a length of another preferred embodiment of a rock bolt in accordance with the present invention.
Figure 10:
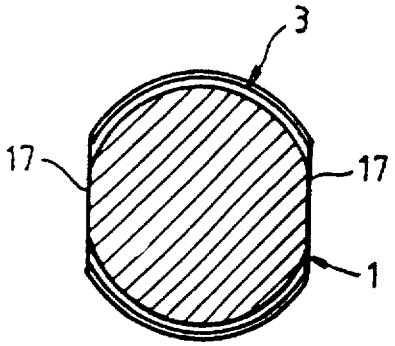
FIG. 10 is an end view in the direction of the arrow A in FIG. 9.

The preferred embodiments of the rock bolt in accordance with the present invention shown in the figures are particularly although by no means exclusively adapted for use in coal or metalliferous mines in which the rock bolt is retained by a cement or a chemical resin grout in a drilled hole.

With reference to the FIGS. 1 to 4, the rock bolt 1 shown in the drawings comprises:

(a) a generally cylindrical core 5 having opposed flats 17; and (b) a profile on the core 5, the profile comprising a single start right-hand thread 3 extending from the core 5 and inclined at an angle of 5° to the transverse axis of the rock bolt 1.

The rock bolt 1 may be formed by any suitable means and of any suitable material. It is preferred that the rock bolt 1 be formed from steel and that the thread 3 be formed on the rock bolt 1 by hot rolling or any suitable cold forming process.

In order to allow the rock bolt 1 to receive a nut (not shown) to tension the rock bolt 1 when retained by grout in a drilled hole (not shown) the rock bolt 1 may comprise a conventional thread (not shown) on one end. In situations where the conventional thread is not formed on the end of an as-manufactured rock bolt 1, the conventional thread may be subsequently cold formed or machined on the rock bolt 1.

The thread 3 in the preferred embodiment of the rock bolt 1 shown in FIGS. 1 to 4 comprises opposed sides, generally identified by the numerals 6, which converge to a ridge or apex 7.

Furthermore, each side 6 of the thread 3 comprises a planar first section 9 to optimise the stiffness properties of a rock bolt system based on the rock bolt 1 and a planar second section 11 to optimise the load transfer properties of a rock bolt system based on the rock bolt 1.

The first sections 9 are steeper than the second sections 11. In this connection, in the preferred embodiment shown in FIGS. 1 to 4, the first sections 9 are formed with an included angle of 60° and the second sections 11 are formed with an included angle of 140°.

The dimensions of the first and the second sections 9, 11 may be selected as required, provided that the dimensions are effective in terms of the functional objectives, namely to optimise stiffness and load transfer properties.

In effect, the thread 3 has a multi-step profile which is formed to control the stress distribution between a rock formation and the rock bolt 1 through the grout thereby to control the transfer of load from the rock formation to the rock bolt 1. More particularly, the multi-step profile is formed to enhance load development in the rock bolt 1 by improving the strength of the grout and improving load transfer between grout/rock formation interface and the grout/rock bolt interface.

The rock bolt 1 may be of any suitable dimensions. When used in coal or metalliferous mines it is preferred that the root diameter of the rock bolt 1 be 12 to 44 mm and that the holes (not shown) in the rock formation be drilled with an annular clearance of 1 to 5 mm, typically 2 mm.

The dimensions and characteristics of a particularly preferred form of the rock bolt 1 shown in FIGS. 1 to 4 having a root diameter of 28 mm is set out below.

| Dimensions and characteristics | Preferred form |
|---|---|
| Total profile height (core 5 to ridge or apex 7) | 2.0 mm |
| Profile height between core 5 and junction of first and second sections 9,11 | 1.27 mm |
| Profile width-top (ie combined width of second sections 11) | 4.0 mm |
| Profile width-bottom (i.e. combined with of first and second sections 9,11) | 5.47 mm |
| Pitch | 9.5 mm |
| Land (space between adjacent threads) | 4.03 mm |
| Core diameter | 28.0 mm |
| Outside diameter | 32.0 mm |

-continued

| Dimensions and characteristics | Preferred form |
|---|---|
| Included angle of first sections 9 | 60 deg |
| Included angle of second sections 11 | 140 deg |

The preferred embodiment of the rock bolt 1 shown in FIGS. 5 to 8 is identical to that shown in FIGS. 1 to 4 save for several minor differences. The differences between the two preferred embodiments are summarised below:

(a) the rock bolt 1 shown in FIGS. 5 to 8 comprises a two-start right handed thread 3 (as opposed to the single start thread of the rock bolt 1 shown in FIGS. 1 to 4);

(b) the first sections 9 of each thread 3 form an included angle of 80° in the rock bolt 1 shown in FIGS. 5 to 8 (as opposed to 60°); and (c) the thread 3 are inclined at an angle of 10° to the transverse axis in the rock bolt 1 shown in FIGS. 5 to 8 (as opposed to 5°).

Figure 11:
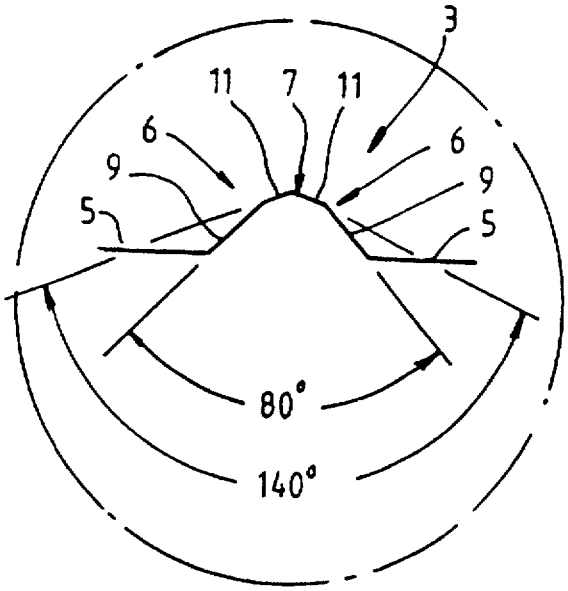
FIG. 11 is an enlarged view of the circled region in FIG. 9.
Figure 12:
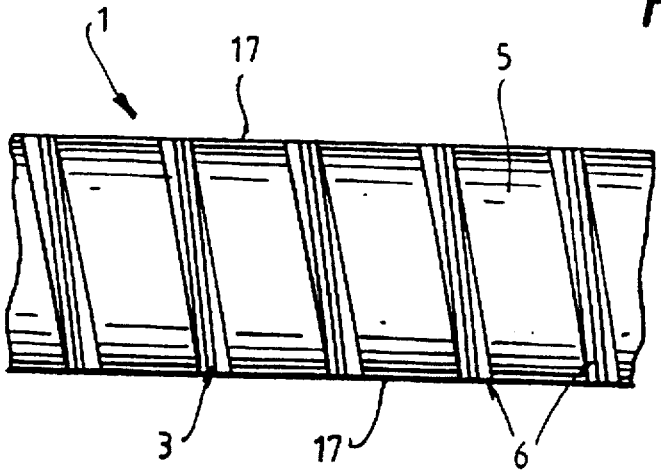
FIG. 12 is a plan view of the section of the rock bolt shown in FIG. 9 rotated through 90° about the longitudinal axis of the rock bolt.
Figure 13:
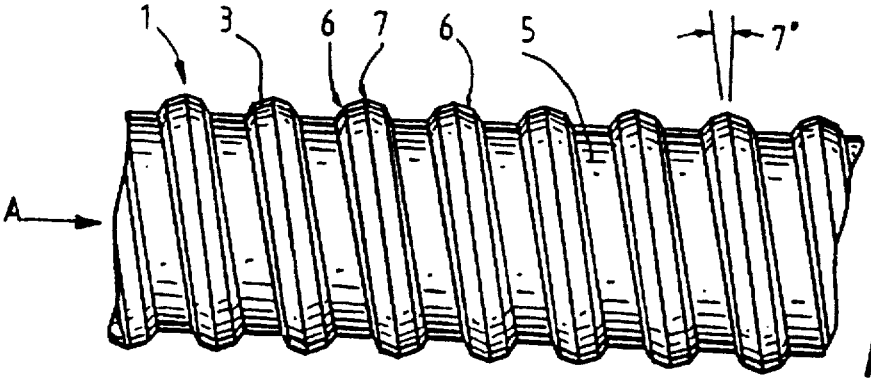
FIG. 13 is a plan view of a section of a length of another preferred embodiment of a rock bolt in accordance with the present invention.
Figure 14:
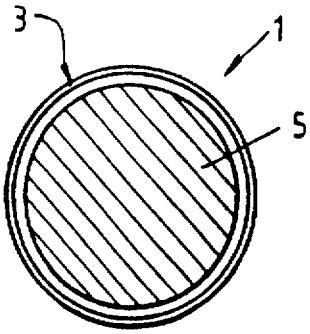
FIG. 14 is an end view in the direction of the arrow A in FIG. 13.
Figure 15:
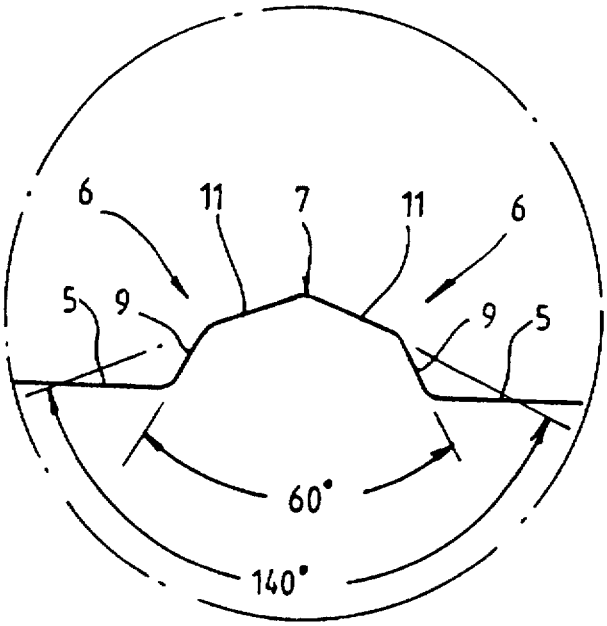
FIG. 15 is an elongated view of the circled region in FIG. 13.
Figure 16:
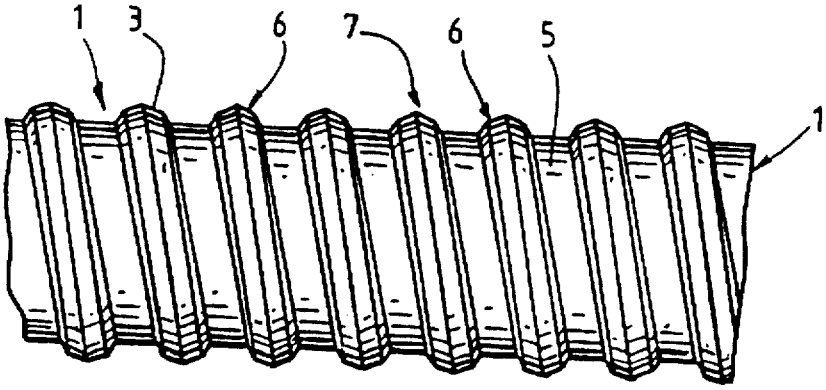
FIG. 16 is a plan view of the section of the rock bolt shown in FIG. 13 rotated through 90° about the longitudinal axis of the rock bolt.

With particular reference to FIG. 11, the profile of the threads 3 in the preferred embodiment of the rock bolt 1 shown in FIGS. 9 to 12 is identical to that shown in FIGS. 5 to 8, with the exception that the width of the threads 3 is narrower than that in the preferred embodiment shown in FIGS. 5 to 8.

The preferred embodiment of the rock bolt 1 shown in FIGS. 13 to 16 is identical to that shown in FIGS. 1 to 4 save for the several minor differences. The differences between the two preferred embodiments are that the rock bolt 1 shown in FIGS. 13 to 16 are summarised below:

(a) the threads 3 is inclined at an angle of 7° to the transverse axis in the rock bolt 1 shown in FIGS. 13 to 16 (as opposed to 5° in the rock bolt, shown in FIGS. 1 to 4) and;

(b) the core 5 is cylindrical (as opposed to the cylindrical core 5 with flats 17 in the rock bolt 1 shown in FIGS. 1 to 4).

Figure 17:
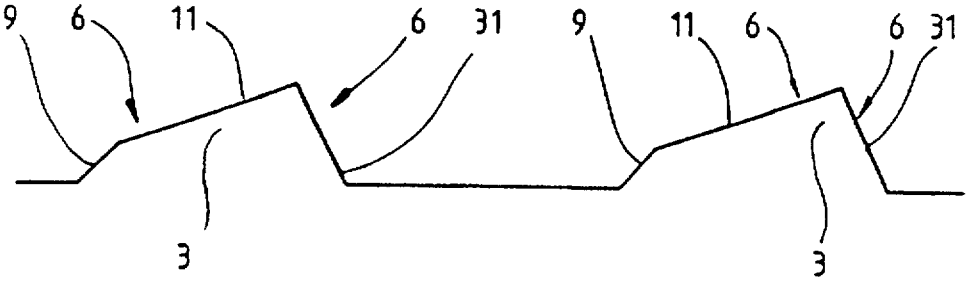
FIG. 17 is an enlarged view, similar to that of FIGS. 3, 7, 11 and 15 of a section of a length of another preferred embodiment of a rock bolt in accordance with the present invention which illustrates in detail the profile of the rock bolt.
Figure 18:
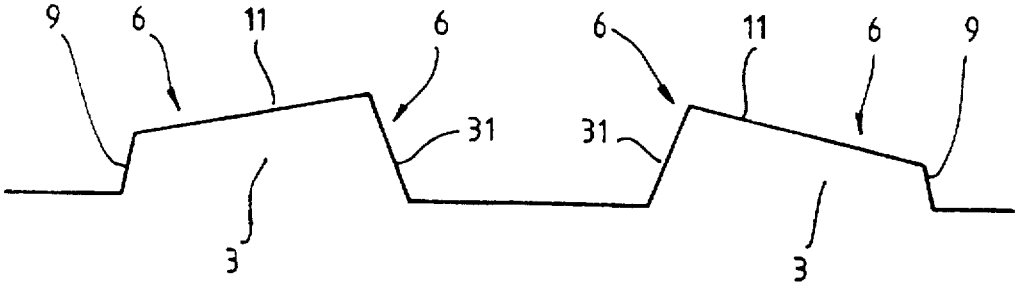
FIG. 18 is an enlarged view, similar to that of FIGS. 3, 7, 11, 15 and 17 of a section of a length of another preferred embodiment of a rock bolt in accordance with the present invention with illustrates in details the profile of the rock bolt.

In the preferred embodiments of the rock bolt shown in FIGS. 17 and 18 only one side 6 of the thread 3 comprises the first and the second sections 9, 11 and the other side 6 comprises a relatively steep face 31.

In the case of the FIG. 17 embodiment the thread profile is repeated along the length of the rock bolt 1. In the case of the FIG. 18 embodiment the adjacent ribs of the thread 3 are mirror images.

It has been found experimentally by the applicant that rock bolt systems which include the multi-step profile rock bolts 1 shown in FIGS. 1 to 18 have significantly better performance than rock bolt systems which are based on conventional rock bolts.

As is discussed above, the performance of a rock bolt system is dependent on the efficiency of transferring load to a rock bolt through grout to a rock formation which in turn is dependent on the load transfer and stiffness properties of the rock bolt system.

The optimum theoretical performance of a rock bolt system can be defined as when a rock bolt develops load rapidly to the desired level and then maintains the load for as long as possible. It has been found experimentally by the applicant that by incorporating a multi-step profile in a rock bolt the optimum theoretical performance of a rock bolt system based on the rock bolt can be approached. In this connection, whilst the load transfer and stiffness properties of a rock bolt system act in association along the profile of the rock bolt, the experimental work of the applicant has shown that by dividing the profile into discrete sections, i.e. the first and second sections 9, 11 it is possible to approach optimum rock bolt performance.

Figure 19:
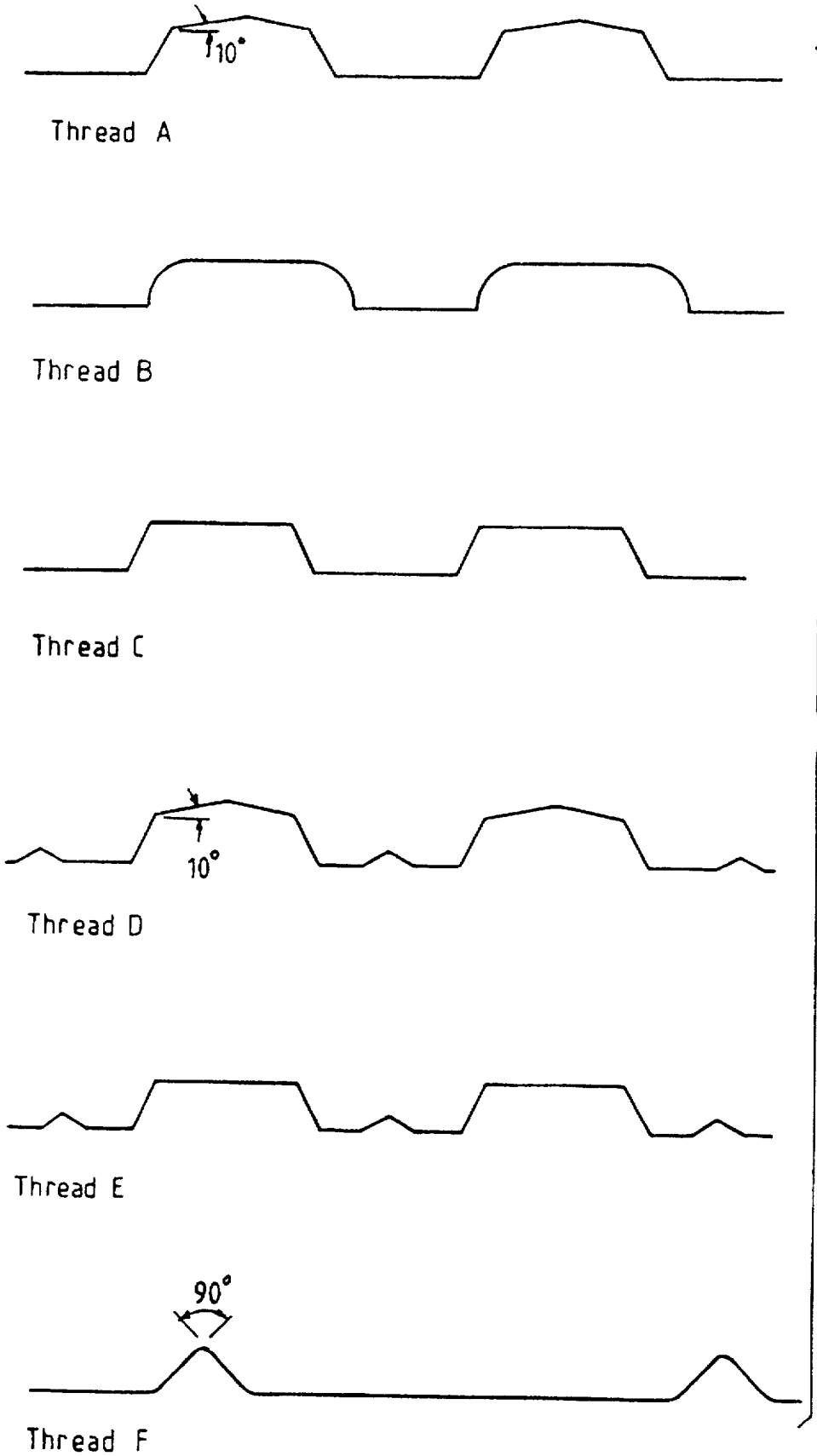
FIG. 19 is a longitudinal section of a part of each of 6 rock bolts tested in experimental work carried out by the applicant.

With reference to FIG. 19, the experimental work of the applicant was carried out on a sample rock bolt 1 of the type shown in FIGS. 1 to 4 (Thread A in FIG. 14), a variation of the rock bolt 1 shown in FIGS. 1 to 4 (Thread D), and 4 other sample rock bolts (Threads B, C, E, and F), one of which is a widely used rock bolt (Thread F).

The experimental work of the applicant comprised a short encapsulation push test that was developed to examine the mechanism of load transfer without the variables that are present in field testing. The most significant advantage of the test is the ability to examine peak load transfer performance without the constraint of yield in a sample. The test also enabled more accurate measurement of the system stiffness compared with field testing.

Figure 20:
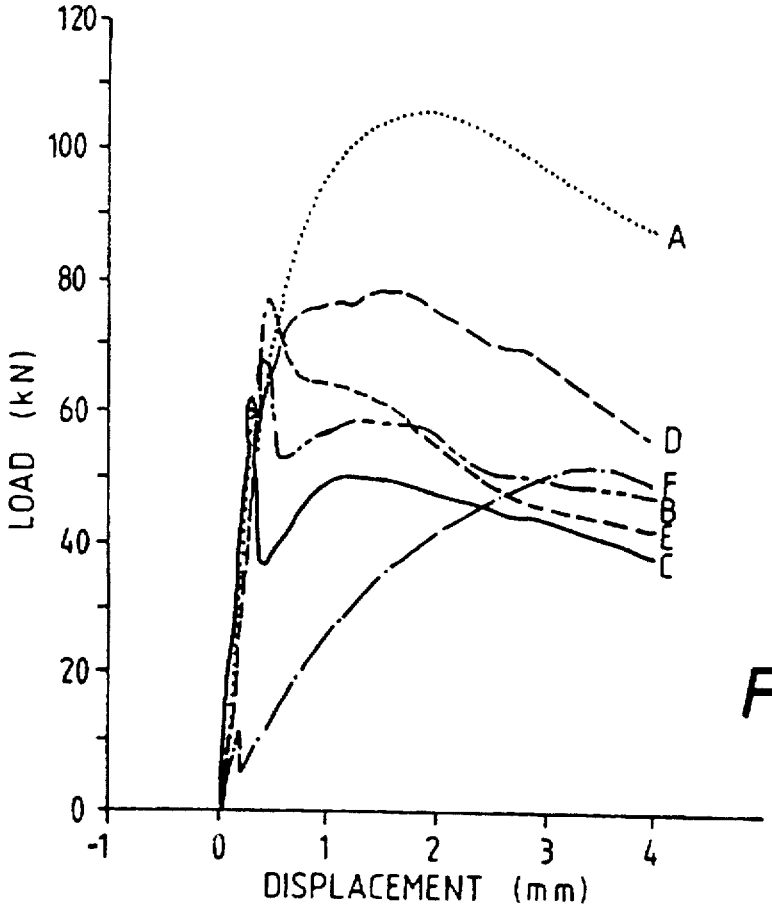
FIG. 20 is a graph of load versus displacement for each of the 6 rock bolts shown in FIG. 19.

The test comprised embedding by means of resin a 70 mm sample rock bolt in a 50 mm metal cylinder having an internal (threaded) surface to prevent premature failure on the cylinder/resin interface. After the resin had cured, the sample rock bolt was pushed through the resin under strain control and the full load/displacement history was recorded. FIG. 20 presents in one figure the load/displacement history of the sample rock bolts (Threads A to F) shown in FIG. 19.

With reference to FIG. 20, it is shown clearly that the rock bolts in accordance with the present invention (Threads A and D) significantly outperformed the other 4 rock bolts and, in particular, the widely used rock bolt (Thread F).

Many modifications may be made to the preferred embodiments described with reference to the drawings without departing from the spirit and scope of the present invention.

In this regard, whilst each preferred embodiments of the rock bolt 1 of the present invention comprises a two-step profile having a first section 9 which is steeper than a second section 11, it can readily be appreciated that the present invention is not so limited and extends to rock bolts having profiles with more than two sections.

In addition, whilst each preferred embodiment of the rock bolt 1 of the present invention comprises planar first and second sections 9, 11, it can readily be appreciated that the present invention is not so limited and the first and second sections 9, 11 may be any suitable shape, such as curved, provided the shape and dimensions are effective to optimise the stiffness or load properties.

In addition, whilst each preferred embodiment of the rock bolt 1 of the present invention shown in FIGS. 1 to 12 comprises a cylindrical core 5 having opposed flats 17 and in FIGS. 13 to 16 comprises a cylindrical core 5 without flats 17, it can readily be appreciated that the present invention is not so limited and extends to any suitable shaped core 5, such as oval or elliptical shaped cores 5.

We claim:

1. A rock bolt adapted to be anchored in a hole in a rock formation by means of a cement or a chemical resin anchor thereby to form a rock bolt system, the rock bolt comprising a core on which is formed a profile for optimizing the load transfer and the stiffness properties of the rock bolt system, the profile comprising opposed first and second sides, wherein at least one of said first and second sides comprises at least a first section and a second section, with first section being steeper than said second section.

2. The rock bolt defined in claim 1, wherein the core is generally cylindrical.

3. The rock bolt defined in claim 1, wherein the core is solid.

4. The rock bolt defined in claim 1, wherein the opposed sides converge to a ridge or apex.

5. The rock bolt defined in claim 1, wherein each of the opposing sides of the profile includes a first section and a second section.

6. The rock bolt defined in claim 1, wherein only one side of the opposing sides of the profile includes a first and a second section.

7. The rock bolt defined in claim 1, wherein one or more of the sections of the profile is planar.

8. The rock bolt defined in claim 1, wherein one or more of the sections of the profile is curved.

9. The rock bolt defined in claim 1, wherein the first section extends from the core to the junction of the first and the second sections.

10. The rock bolt defined in claim 1, wherein the first section describes an angle of 40° to 80° with a longitudinal axis of the rock bolt.

11. The rock bolt defined in claim 10, wherein the angle is 45° to 65°.

12. The rock bolt defined in claim 1 wherein the second section describes an angle of 10° to 40° with a longitudinal axis of the rock bolt.

13. The rock bolt defined in claim 12, wherein the angle is 10° to 30°.

14. The rock bolt defined in claim 5, wherein the first sections are planar and describe an included angle of 40° to 100°.

15. The rock bolt defined in claim 14, wherein the included angle is 50° to 90°.

16. The rock bolt defined in claim 15, wherein the included angle is 55° to 75°.

17. The rock bolt defined in claim 5, wherein the second sections are planar and describe an included angle of 100° to 160°.

18. The rock bolt defined in claim 17, wherein the included angle is 120° to 160°.

19. The rock bolt defined in claim 1, wherein the total width of the profile, as measured between the junctions of the first sections and the core, is 2 to 10 mm.

20. The rock bolt defined in claim 19, wherein the total width of the second section(s) of the profile is 40 to 85% of the total width of the profile.

21. The rock bolt defined in claim 1, wherein the height of the profile is 0.75 to 5 mm.

22. The rock bolt defined in claim 21, wherein the height of the profile is 1 to 3 mm.

23. The rock bolt defined in claim 1, wherein the profile is a series of ribs.

24. The rock bolt defined in claim 23, wherein the pitch of the ribs is 5 to 20 mm.

25. The rock bolt defined in claim 24, wherein the pitch is 6 to 12 mm.

26. The rock bolt defined in claim 23, wherein the ribs form a thread.

27. The rock bolt defined in claim 1, wherein the profile is a hoop.

28. The rock bolt defined in claim 27 comprising a plurality of the hoops spaced along the length of the rock bolt.

29. The rock bolt defined in claim 2, wherein the core is solid.

30. The rock bolt defined in claim 26, wherein a configuration of the thread is selected from the group consisting of:

(a) continuous, left-handed, and single start;

(b) continuous, left-handed, and multi-start;

(c) continuous, right-handed, and single start;

(d) continuous, right-handed, and multi-start;

(e) discontinuous, left-handed, and single start;

(f) discontinuous, left-handed, and multi-start;

(g) discontinuous, right-handed, and single-start; and (h) discontinuous, right-handed, and multi-start.

* * * * *